US006874905B1

(12) United States Patent
Beadle

(10) Patent No.: US 6,874,905 B1
(45) Date of Patent: Apr. 5, 2005

(54) PATHWAY LIGHT FIXTURE

(76) Inventor: Joshua Z. Beadle, 5362 Caminito Vista Lujo, San Diego, CA (US) 92130

( * ) Notice: Subject to any disclaimer, the term of this patent is extended or adjusted under 35 U.S.C. 154(b) by 169 days.

(21) Appl. No.: 10/368,864

(22) Filed: Feb. 19, 2003

(51) Int. Cl.[7] ..... F21V 21/14

(52) U.S. Cl. ..... 362/153.1; 362/267; 362/158; 362/141; 362/351; 362/270; 362/372

(58) Field of Search ..... 362/153, 153.1, 362/270, 364, 372, 267, 414, 351, 360, 359, 362/158

(56) References Cited

U.S. PATENT DOCUMENTS 4,999,060 A * 3/1991 Szekely et al. ..... 136/251
5,226,721 A 7/1993 Stokes
5,481,443 A 1/1996 Wagner et al.
5,718,506 A 2/1998 Yeh
5,908,236 A 6/1999 Lueken et al.
6,357,892 B1 3/2002 Beadle
6,422,717 B1 7/2002 Beadle
6,491,407 B1 12/2002 Beadle
6,612,720 B1 9/2003 Beadle

* cited by examiner

*Primary Examiner*—Stephen Husar
*Assistant Examiner*—Anabel Ton

(57) ABSTRACT

A light fixture for use in low voltage outdoor lighting systems that comprises a lens assembly with a reflector, lens and lens support and a socket assembly with a lamp, socket and socket housing, which are mounted on a post. Connection of the lens assembly and socket assembly is provided by the combination of a taper fit and multiple O-rings which provide a frictional fit that is sealed against dirt and moisture intrusion, avoiding metal-to-metal contact. Attachment of the lens assembly to the socket assembly is achieved by pressing the two parts together in an axial direction. Disassembly is achieved by twisting to overcome the friction generated by the O-rings and pulling the two assemblies apart. A locking screw may be used to prevent accidental separation of the lens assembly and socket assembly. The post can be attached to a ground spike for installation.

19 Claims, 2 Drawing Sheets

PATHWAY LIGHT FIXTURE

FIELD OF THE INVENTION

The invention relates to a light fixture for use in low voltage outdoor lighting systems and more specifically to a pathway light fixture which is readily assembled and disassembled.

BACKGROUND OF THE INVENTION

Environmental lighting, particularly outdoor lighting, is well known in commercial or public settings, such as parks and schools. Such lighting is also popular in residential applications, both to enhance the appearance and safety of the outdoor area and for security, to illuminate dark areas around a building or in a yard which may provide hiding places and unobserved entry points for intruders.

Landscape and outdoor lighting systems include one or more lighting fixtures which are connected to either a 12 V transformer or a standard 120 VAC line. Some lighting fixtures enclose a halogen lamp or conventional bulb within a housing, and include a reflector assembly and a lens or window. These fixtures may be used for highlighting features such as trees or statues, i.e., up-lighting or for pathway or ground lighting. Other fixtures, used almost exclusively in down-lighting applications, may be open, with the lamp inserted into a socket within a shell or cowl that has its open end directed toward the ground. These fixtures tend to be used in larger quantities within a lighting system since they are typically less expensive than the closed fixtures and are capable of washing large expanses of open area with glare-free light, e.g., pathways, driveways, patios, ground cover plants and for perimeter lighting.

Pathway lighting fixtures often have a hood or cowl shaped in the form of a bell, half-shell, cone, tulip, or other bell-shaped flower that surrounds the lamp except for the lower end of the cowl from which the light emanates. In addition to preventing escape of light in an upward direction, the inner surface of the cowl acts as a reflector to optimize the amount of light directed toward the desired target area.

Outdoor light fixtures are prone to dirt build-up and/or corrosion which can diminish light output and accelerate deterioration and, ultimately, failure of the fixture. In open fixture designs, effects of dirt build-up and/or oxidation can be minimized by treating the inner surface of the cowl by coating it with a white paint or powder coating to produce a reflective, corrosion-resistant finish. However, the lamp and socket remain exposed and, therefore, can deteriorate with time, interfering with the lamp and socket connection. In closed fixtures, the effects of dirt build-up and/or oxidation can be reduced by sealing the lamp enclosure to create a moisture-proof chamber. Any accumulation of material on the lens can be easily wiped away to restore full illumination capability. However, in closed fixture designs, one must disassemble the housing to access the lamp for replacement. Where metal-to-metal contact occurs in the enclosure seal, the built-up dirt and/or corrosion can act to "weld" the connection closed, making it very difficult to remove fasteners or separate sections of the housing. Efforts to break the connection can result in frustration and lead to the use of heavy pliers, wrenches or other tools to pry the sections apart, which can damage the housing finish. Further, after replacement of the lamp, unless extreme care is used, the built-up dirt and/or corrosion can impair the formation of a watertight seal, thus exposing the internal components to the outside elements, allowing the fixture to deteriorate with time.

It would be desirable to provide a pathway light fixture that is attractive, resists breakdown in an outdoor environment, and easy to manufacture and service. The problems and deficiencies are clearly felt in the art and are solved by the present invention in the manner described below.

SUMMARY OF THE INVENTION

It is an advantage of the present invention to provide a pathway light fixture which has a moisture-proof seal to fully enclose the lamp to protect the lamp and socket against exposure to the elements and intrusion by foreign objects.

It is a further advantage of the present invention to provide a pathway light fixture with improved resistance to deterioration by corrosion and oxidation of the materials of which the fixture is made.

Another advantage of the present invention is to provide a pathway light fixture which is easily assembled and disassembled while retaining its moisture-proof seal.

In an exemplary embodiment, the pathway light fixture for outdoor installation comprises a stem, a socket assembly disposed in the top of the stem for retaining a halogen lamp, a lens support, a diffuser and a reflector top. The lens support is formed with a generally conical outer shape and an annular recess that is dimensioned to receive the outer diameter of the socket assembly. The recess in the lens support is slightly tapered so that it has a larger diameter at its lower end. The cylindrical diffuser is retained in an annular channel formed in the upper surface of the lens support, where it is sealed with a silicone, epoxy or other water-tight sealant. The flared reflector has a cylindrical portion which fits closely over the top of the diffuser lens where it is sealed using silicone, epoxy or other sealant to protect the internal surfaces of the lighting fixture from moisture intrusion.

The socket assembly includes a generally cylindrical socket housing that has a lower portion with a first outer diameter adapted to closely fit within the inner diameter of the hollow stem where it is sealed in place using an epoxy or other sealant. The upper portion of the socket housing has a second outer diameter larger than the first outer diameter. Annular channels are formed in the second outer diameter to act as O-ring seats for receiving O-rings which generate friction when inserted into the recess in the lens support. The taper of the recess allows easy insertion upon initial alignment of the socket housing with the recess in the lens support, then increasing friction as the O-rings are pressed deeper into the recess. The seal is formed between the O-rings and the inner surface of the lens support, such that direct metal-to-metal contact is avoided. The seal that is created is both firm and water-proof, however, when maintenance is required, i.e., when the lamp needs to be replaced, the seal can be easily released by twisting the lens support relative to the base connector and simultaneously pulling the sections apart to overcome the friction created by the O-ring to metal contact. Since there is no direct metal-to-metal contact, the effects of outdoor exposure are minimized and the connection will not subject to seizing as the result of corrosion, oxidation or dirt.

A bore formed along the axial center of the socket housing has a second inner diameter for receiving a commercially-available socket. The plastic socket is interference-fit within the second diameter of the socket housing and has an upper portion with electrical contacts into which the halogen lamp is plugged and a lower portion for attachment of conductive wires. Wires connected to the electrical contacts within the socket extend from the plastic socket, passing through the socket housing and stem for connection to a voltage source.

For installation, the stem typically has a threaded fitting at its distal end allowing connection to a riser pipe or ground spike. In the preferred embodiment, the threaded fitting comprises a plug inserted into the stem with a threaded portion extending from the end of the stem.

BRIEF DESCRIPTION OF THE DRAWINGS

Understanding of the present invention will be facilitated by consideration of the following detailed description of a preferred embodiment of the present invention taken in conjunction with the accompanying drawings, in which like numerals refer to like parts and in which.

DETAILED DESCRIPTION OF THE INVENTION

Figure 1:
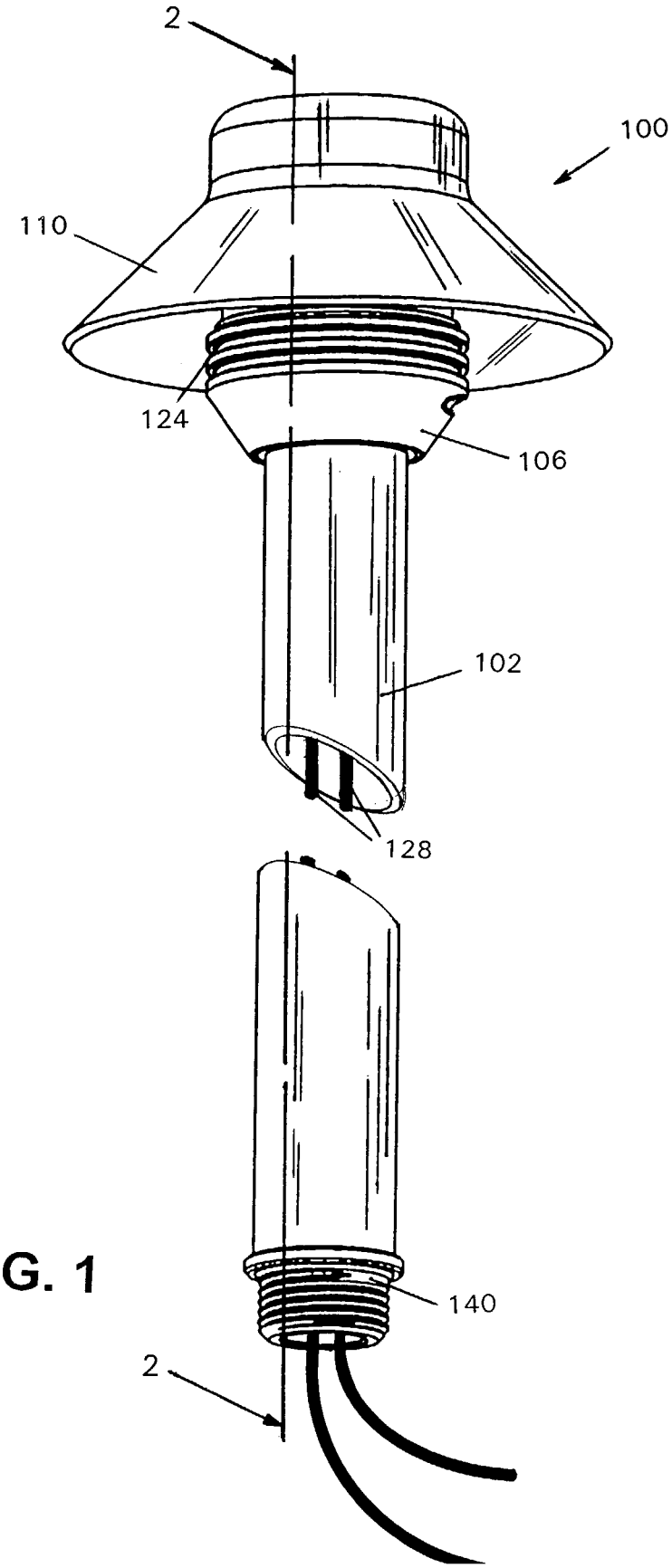
FIG. 1 is a perspective view of the light fixture.

FIG. 1 illustrates a pathway lighting fixture generally designated by reference numeral 100. The lighting fixture 100 includes a stem in the form of a generally elongated tubular post 102 with a first end and a second end, the first end to which is attached to the lower end of the socket housing 104, and a lens assembly, which encloses the electrical components in a moisture-proof enclosure, comprising a cylindrically-shaped diffuser lens 108 (not visible in FIG. 1) disposed in the upper end of lens support 106, and a symmetrically flared reflector 110. Post 102 and reflector 110 should be made of a durable and aesthetically pleasing material. In the preferred embodiment, post 102 and reflector 110 are formed from solid copper, which is intended to oxidize to a verde finish and, thus, is preferably uncoated. Other corrosion resistant materials may be used as well, including stainless steel, anodized aluminum, powder-coated or painted metal, or high temperature plastics or composites.

Figure 2:
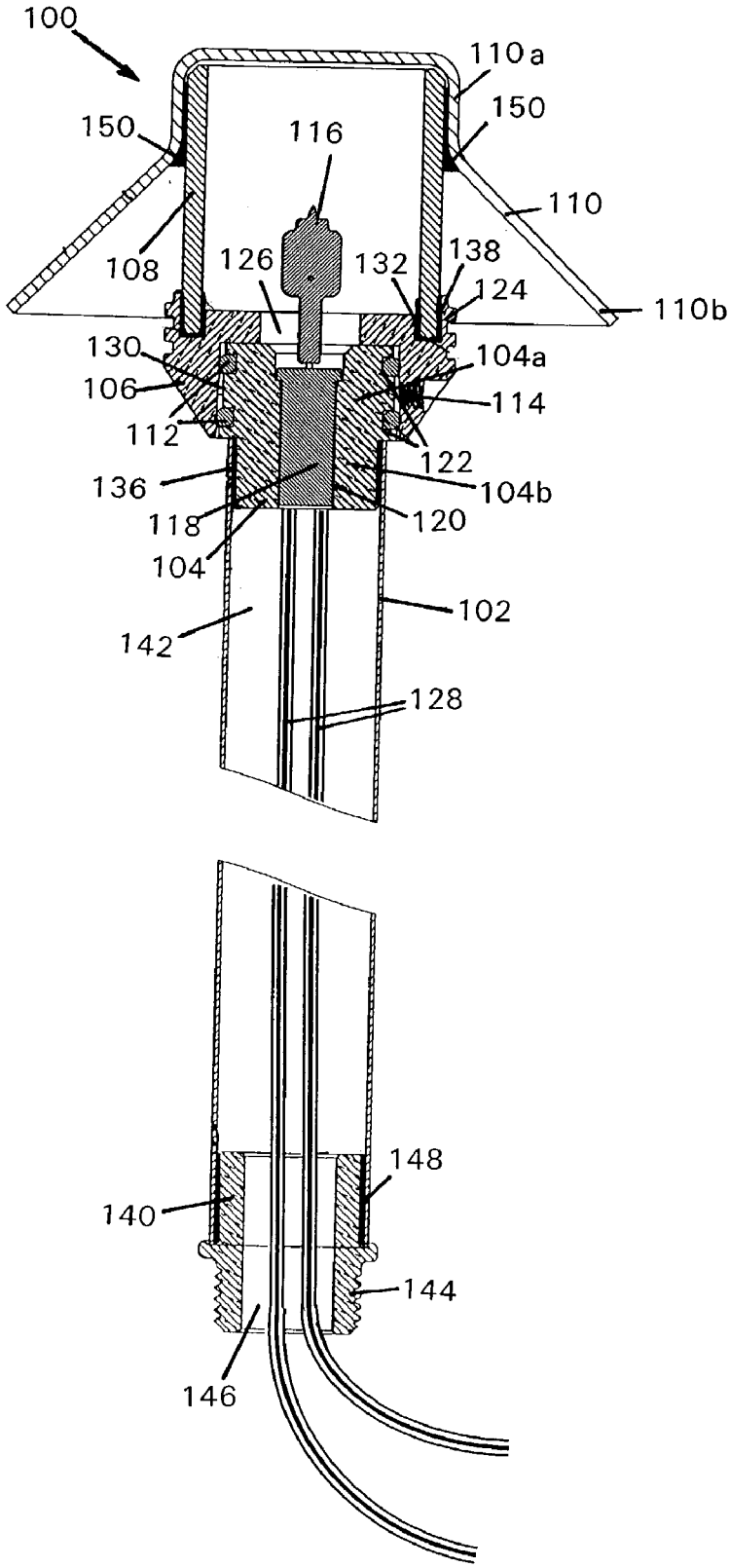
FIG. 2 is a cross-sectional view of the fixture taken along line 2—2 of FIG. 1.

The elements of lighting fixture 100 are shown in FIG. 2. Tubular post 102 has a first (upper) end, a second (lower) end, and a substantially hollow interior 142 through which electrical wires 128 pass to provide connection to a cable connected to a voltage source (not shown). In the socket assembly, socket housing 104 is generally cylindrical in shape and has a lamp end 104*a*, which has a first diameter, and a base end 104*b*, with a second diameter smaller than the first diameter and which is adapted to closely fit within the first end of post 102, where it is sealed in place by an epoxy, silicone or other appropriate adhesive. Socket housing 104 retains the electrical components, i.e., the lamp 116 and socket 118, all of which combined comprise the socket assembly. The lower portion of socket 118 is inserted into a bore 120 which is formed along the central axis of socket housing 104 so that wires 128 extend from the base end 104*b* of socket housing 104 and down into post 102. It should be noted that wires 128 are shown as extending from socket 118 through the length of post 102 for simplicity. More typically, as will be readily apparent to those of skill in the art, wires 128 are connected within post 102 via standard connectors to conductors in a low voltage cable which, in turn, is connected to a terminal of a low voltage transformer.

In the lens assembly, lens support 106 has an exterior shape that is generally cylindrical or a frustum, as shown, with a hollow interior. In the preferred embodiment, lens support 106 is formed from brass. Annular channels 124 may be formed in the outer surface for primarily aesthetic reasons, however, such channels can facilitate gripping the lens assembly during disassembly and reassembly of the fixture. A concentric bore 126 near the upper portion of lens support 106 has an inner diameter adapted to permit the lamp to pass through freely when the fixture is assembled and disassembled. A lower bore 134 is formed to provide a recess that is dimensioned to receive lamp end 104*a* of socket housing 104. Lower bore 134 has an inner sidewall which is slightly tapered so that it has a larger diameter at the lower end of lens support 106 and tapers to a smaller diameter progressing upward into the recess.

Returning to the description of a preferred embodiment of the socket assembly, the lamp end 104*a* of socket housing 104 is generally cylindrical in shape and has two annular O-ring seats 122 formed in its outer sidewall. Each O-ring seat 122 retains an O-ring 112*a* or 112*b*, which, in the preferred embodiment, is a silicone O-ring, which provides good weather resistance over long periods over time. Such O-rings are widely commercially available from manufacturers such as American Seal, Inc. of Houston, Tex., or Seal Science, Inc. of Irvine, Calif. The size (cross-sectional dimension) of each O-ring 112*a, b* is selected so that it extends well beyond the outer sidewall of lamp end 104*b* so that a good seal is achieved while a gap 130 is maintained between the outer sidewall of socket housing 104 and the inner sidewall of lower bore 134 of lens support 106. The tapered dimensions of lower bore 134 permit upper O-ring 112*a* to pass freely into the lower, wider opening. Then, as lamp end 104*a* is inserted more deeply into lower bore 134, the O-rings begin to compress and friction increases, first against upper O-ring 112*a* then against O-ring 112*b*, creating a tight seal. Upper O-ring 112*a* provides the primary frictional resistance against separation of the two components, while lower O-ring 112*b* acts as a protective seal to prevent access by dirt and moisture intrusion to the upper O-ring 112*a* as well as providing a secondary, lesser degree of frictional resistance. By protecting the upper O-ring 112*a*, the seal remains clean and unaffected by dirt or moisture. Therefore, the minimum number of O-rings is two to enable the O-rings to perform the described dual purposes. If desired, additional O-rings, e.g., three, four or more, may be used to increase the seal and/or frictional resistance against separation. The combination of O-rings 112*a, b* and gap 130 ensures that there is no metal-to-metal contact between the two surfaces where dirt and/or corrosion can seize the two components and interfere with the ability to separate the components when disassembly is required.

In the preferred embodiment, socket housing 104 is formed from brass. The epoxy 136, silicone or other adhesive used to attach the base connector to post 102, in addition to creating a water-tight seal, provides insulation between the outer surface of base end 104*b* and the inner surface of post 102 to minimize direct metal-to-metal contact and the resulting possible enhancement of corrosion by galvanic action between the brass and copper.

A socket 118 having a first (upper) end and a second (lower) end is formed from a non-conductive body of plastic or other durable, non-conductive materials. A pair of metal conductors (not shown) passes through the body where they are configured to receive the conductive prongs of a conventional lamp at the first end. At the second end, conductive wires 128 enter the socket where they are attached to the metal conductors to provide for connection to a low voltage cable and voltage source, such as a transformer. Socket 118 is inserted through central bore 120 in socket housing 104 where it is firmly held by an interference fit. The outer surface of the socket may be configured with a series of small vertically aligned ribs (not shown) to enhance the grip between the outer surface of socket 118 and the inner surface of bore 120. In the preferred embodiment, socket 118 is commercially-available from BJB of Amsberg, Germany, as Part No. 25.114.1121.90, which is a lamp holder with a push fixing for a 7.8 mm cut out. Selection of other types of sockets of similar specifications will be apparent to those of skill in the art.

Lamp 116 is preferably a halogen filament-type lamp but can also be tungsten filament, incandescent, or other comparable lamp commonly used in similar lighting applications. The voltage supply (not shown), is preferably a low voltage (12 V) transformer which is connected to 120 VAC.

In the lens assembly, reflector 110 is generally bell shaped with a crown portion 10*a* which is generally cylindrical and a skirt portion 110*b* which flares out from the crown portion 110*a* to form a frustum. Reflector 110 may be formed by machining, die casting, molding, or any other procedure appropriate for the selected materials. Other shapes may be substituted as long as a sufficient recess is provided to enclose the lamp and socket sufficiently to prevent direct viewing of the lamp from above the fixture. For example, tulip or other bell-like flower shapes, pyramids, half-shells, such as a scallop shell, or cones may be used. The shapes are not limited to rounded or symmetrical shapes.

A cylindrical lens 108, which surrounds halogen lamp 116, has an outer diameter and thickness adapted to fit within channel 132, which is formed in the upper edge of lens support 106, and an outer diameter to fit closely within crown portion 110*a* of reflector 110. Lens 108 can be transparent or translucent glass, plastic or similar material, preferably impact resistant and capable of withstanding outside environmental conditions without degradation. In the preferred embodiment, lens 108 is a frosted, tempered glass to serve as a diffuser, providing uniform dispersion of light and optimal tolerance of moisture, temperature and sunlight exposure. A diffuser can also be provided by forming a knurled, ribbed or other roughened texture on the inner surface of lens 108. An adhesive 138, such as epoxy, silicone or other adhesive is placed in channel 132 to provide a seal against moisture intrusion and to act as a shock-absorber for the lens. Reflector 110 is mounted concentrically atop lens 108, with the upper portion of lens 108 inserted into the crown portion 110*a* of reflector 110 and fixed in place with the application of a epoxy, or silicone-based or similar adhesive 150 that can create a watertight seal. In the preferred embodiment, at least two applications of the adhesive are made in order to seal the enclosure from infiltration by moisture and/or dirt. Due to the flexible nature of the adhesive, an ample application of adhesive can also act as a shock-absorber to reduce the possibility of lens breakage if the fixture is struck or jarred.

Locking screw 114 passes through a threaded bore in lens support 106. When fully inserted, screw 114 presses against the outer surface of socket housing 104 to prevent accidental or unauthorized disassembly of the fixture. Fasteners other than a screws may be used, to provide all or a part of the function of screw 114.

At the second, lower end of post 102, end plug 140 is partially inserted into the opening to provide for attachment of the fixture to a mounting device. End plug 140 has a central bore 146 extending therethrough and a threaded portion 144 which extends beyond the lower end of post 102. In the preferred embodiment, threaded portion 144 has external threads of a standard thread pattern, e.g., ½" NPS male thread, which cooperate with female threads of a molded plastic ground spike which can then be inserted into the ground. In this exemplary installation (not shown), wiring 128, or preferably a low voltage burial-type cable connected to wiring 128, exits the second end of post 102 through central bore 146, is threaded through an opening in the ground spike, and then continues to termination at the transformer. Other forms of mounting the fixture in place will be readily apparent to those of skill in the art, including mounting the fixture on a riser which may be attached to a ground spike or other support. In the preferred embodiment, end plug 140 is formed from brass and is sealed within the lower end of post 102 using an adhesive 148 such as epoxy, silicone, or other appropriate adhesive to provide a water-resistant seal. The adhesive 148 further acts as an insulator between the two metals to minimize metal-to-metal contact and possible accelerated corrosion by galvanic action.

Assembly of the light fixture 100 is achieved by pressing the lens assembly against the socket assembly in an axial direction until the upper end 104*a* of socket housing 104 is fully inserted into the recess provided by lower bore 134. The O-rings 112 provide an increasing resistance as the two assemblies are pushed together to create a good seal once upper end 104*a* is inserted to its fullest possible extent into lower bore 134. Using an appropriate tool such as a screwdriver or hex key, depending on the type of screw, locking screw 114 is then tightened to press against the outer surface of socket housing 104, securing the assembly. The need to disassemble the fixture for maintenance purposes, e.g., changing the lamp, typically arises after the fixture has been mounted in place in the outdoor setting. Therefore, for disassembly, locking screw 114 is first loosened using an appropriate tool. Then, while holding post 102, the lens assembly is twisted to break the friction created by the O-ring, then lifted away from the socket assembly to expose the lamp 116. After replacement of the lamp, the fixture is reassembled as described above.

The light fixture of the present invention overcomes several disadvantages of the prior art relating to corrosion and oxidation of the fixtures which result in seized metal parts or failed lamp and socket connection due to unwanted moisture intrusion. Further, the light fixture is easy to manufacture, assemble and disassemble while maintaining a high quality seal so as to reduce the opportunity for moisture and dirt intrusion into the fixture which can interfere with operation and/or shorten the lifetime of the fixture.

Obviously, other embodiments and modifications of the present invention will occur readily to those of ordinary skill in the art in view of these teachings. Therefore, this invention is to be limited only by the following claims which include all such other embodiments and modifications when viewed in conjunction with the above specification and accompanying drawings.

I claim:

1. A pathway light fixture, comprising:

a mounting post;

a socket assembly comprising:

a lamp, a socket for retaining and providing electrical connection to the lamp; and a socket housing having a generally cylindrical shape and a bore therethrough for retaining the socket, wherein the socket housing has an upper end and a lower end, the lower end adapted for attachment to the mounting post, and the upper end having an outer sidewall with an outer diameter and at least two O-ring seats formed in the outer sidewall;

an O-ring disposed in each of the at least two O-ring seats, the O-ring having an outer diameter greater that the outer diameter of the outer sidewall;

a lens assembly comprising:

a lens adapted for transmitting light from the lamp away from the fixture, the lens being generally cylindrical and having an upper end, a lower end and an outer diameter;

a reflector having an upper portion adapted to closely fit over the upper end of the lens and a lower portion adapted to reflect light in a downward direction; and a lens support having a generally cylindrical shape, an upper end having a channel formed therein for receiving the lower end of the lens, a lower end, and a bore therethrough, the lower end having a recess adapted to receive the upper end of the socket housing, wherein the recess has an inner diameter with an inner sidewall that is tapered to provide an increasing diameter toward the opening of the recess and the inner diameter is greater than the outer diameter of the upper end of the socket housing;

wherein, as the upper end of the socket housing is inserted into the recess, the O-rings generate increasing friction against the inner sidewall as the socket housing is pushed further into the recess to retain the socket housing within the recess and to form a water-tight seal between the socket housing and the lens support, and wherein a gap remains between the inner sidewall and the outer sidewall so that metal-to-metal contact between the sidewalls is avoided.

2. The pathway light fixture of claim 1, wherein the mounting post comprises a hollow tube and further comprising a plug for insertion into a lower end of the hollow tube, the plug having a male threaded portion extending therefrom for attachment to a mounting device.

3. The pathway light fixture of claim 2, further comprising an adhesive disposed between the mounting post and each of the plug and the socket support.

4. The pathway light fixture of claim 3, wherein the adhesive is epoxy or silicone and the adhesive creates a water-tight seal and acts as an insulator between the mounting post and each of the plug and the socket support.

5. The pathway light fixture of claim 1, further comprising an adhesive disposed between each of the lens and the reflector, and the lens and the lens support.

6. The pathway light fixture of claim 5, wherein the adhesive is epoxy or silicone and the adhesive creates a water-tight seal and acts as a shock-absorber for the lens.

7. The pathway light fixture of claim 1, wherein each of the reflector and the post are formed from copper.

8. The pathway light fixture of claim 1, wherein each of the lens support and the socket support are formed from brass.

9. The pathway light fixture of claim 1, further comprising a locking screw disposed in a bore extending radially through the lens support.

10. The pathway light fixture of claim 1, wherein the lens comprises a diffuser.

11. A pathway light fixture for an outdoor lighting system comprising:

a lamp;

a socket for retaining and providing electrical connection to the lamp;

a socket housing for retaining the socket, the socket housing having a generally cylindrical shape with an upper portion and a lower portion, the upper portion having an outer sidewall with an outer diameter, an upper O-ring seat and a lower O-ring seat disposed in the outer sidewall;

two O-rings, one O-ring disposed in each of the upper and lower O-ring seats;

a lens support having a generally cylindrical shape, an upper portion having a bore through which the lamp may pass, and a lower portion having a recess with tapered sidewalls and an inner diameter, wherein the recess is adapted to receive the upper portion of the socket housing and the two O-rings so that the upper O-ring disposed in the upper O-ring seat contacts the tapered sidewalls of the recess before the lower O-ring disposed in the lower O-ring seat as the upper portion of the socket housing is inserted into the recess and the upper O-ring generates friction against the outer sidewall of the socket housing to resist separation of the lens support and the socket housing and the lower O-ring prevents intrusion of contaminants into a gap formed between the outer sidewall of the socket housing and the tapered sidewall of the recess;

a diffuser lens attached to the upper portion of the lens support;

a reflector affixed on top of the diffuser so that a combination of the lens support, diffuser lens and reflector create a water tight seal around the lamp and socket; and a post having an upper end adapted for attachment to the lower end of the socket housing and a lower end for attachment to a mounting device.

12. The pathway light fixture of claim 11, wherein the mounting post comprises a hollow tube and further comprising a plug for insertion into a lower end of the hollow tube, the plug having a male threaded portion extending therefrom for attachment to a mounting device.

13. The pathway light fixture of claim 12, further comprising an adhesive disposed between the mounting post and each of the plug and the socket support, wherein the adhesive creates a water-tight seal and acts as an insulator between the mounting post and each of the plug and the socket support.

14. The pathway light fixture of claim 13, wherein the adhesive is epoxy or silicone.

15. The pathway light fixture of claim 11, further comprising an adhesive disposed between each of the lens and the reflector, and the lens and the lens support, wherein the adhesive creates a water-tight seal and acts as a shock-absorber for the lens.

16. The pathway light fixture of claim 15, wherein the adhesive is epoxy or silicone.

17. The pathway light fixture of claim 11, wherein each of the reflector and the post are formed from copper.

18. The pathway light fixture of claim 11, wherein each of the lens support and the socket support are formed from brass.

19. The pathway light fixture of claim 11, further comprising a locking screw disposed in a bore extending radially through the lens support.

* * * * *